United States Patent [19]

Hansen et al.

[11] 4,116,031

[45] Sep. 26, 1978

[54] FLUX CONCENTRATOR FOR ELECTROMAGNETIC PULLING

[75] Inventors: Karl A. Hansen; I. Glen Hendrickson, both of Seattle, Wash.

[73] Assignee: The Boeing Company, Seattle, Wash.

[21] Appl. No.: 752,755

[22] Filed: Dec. 20, 1976

[51] Int. Cl.[2] ..... B21D 26/14

[52] U.S. Cl. ..... 72/56; 72/705; 72/DIG. 30; 361/139; 361/143

[58] Field of Search ..... 72/56, DIG. 30, 705; 361/139, 143, 210, 152; 335/243, 209, 296; 336/223, 181

[56] References Cited

U.S. PATENT DOCUMENTS

| | | | |
|---|---|---|---|
| 3,196,649 | 7/1965 | Furth | 72/56 |
| 3,271,716 | 9/1966 | Furth | 336/181 |
| 3,703,958 | 11/1972 | Kolm | 361/143 X |
| 3,743,898 | 7/1973 | Staurman | 361/210 X |

FOREIGN PATENT DOCUMENTS

| | | | |
|---|---|---|---|
| 2,030,497 | 11/1970 | France | 72/56 |

*Primary Examiner*—Leon Gilden
*Attorney, Agent, or Firm*—Morris A. Case; B. A. Donahue

[57] ABSTRACT

A flux concentrator has a pair of primary coils wrapped around a thin walled cylindrical portion of a secondary coil. The secondary coil has a conductive head at an end and the coil is slotted to generate a rapid high intensity axially acting flux at the head in response to a flow of current through the primary coils. A pulling force is generated as a result of a slow rise high amplitude current flow through one of the coils followed by a rapid rise reversed polarity current flow through the second primary coil.

15 Claims, 13 Drawing Figures

Fig. 5
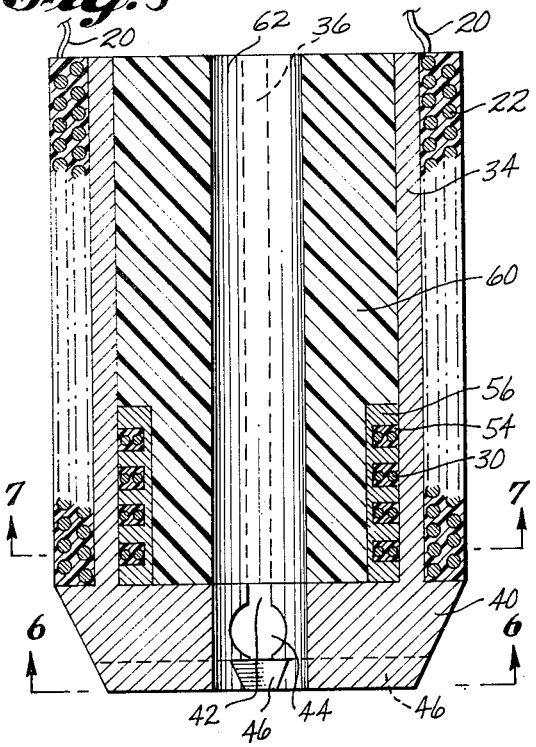
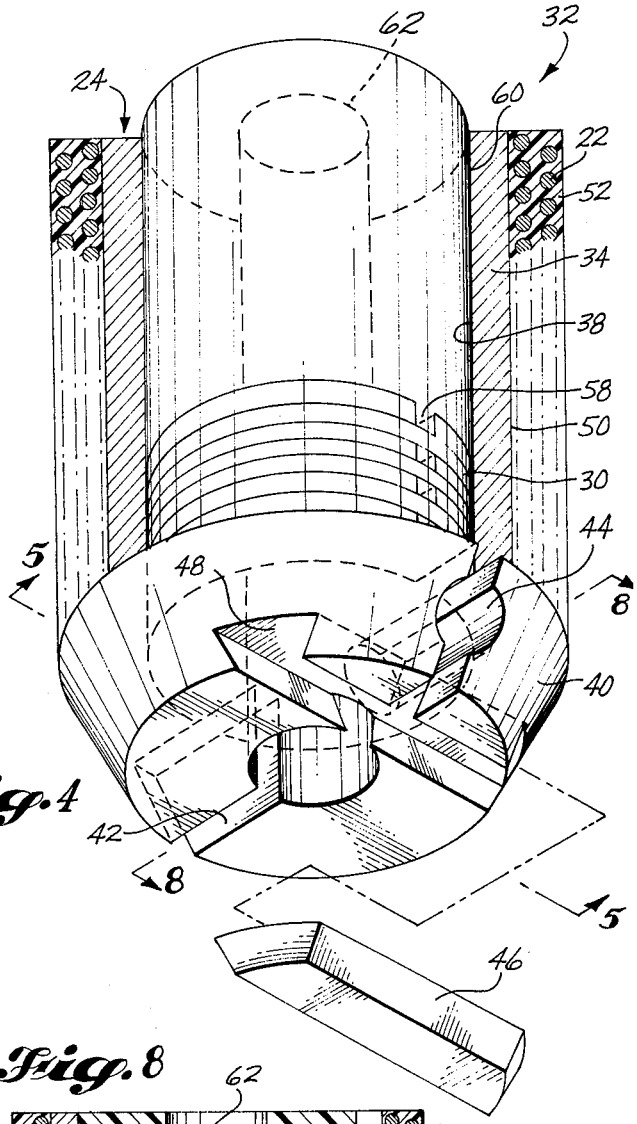
Fig. 4
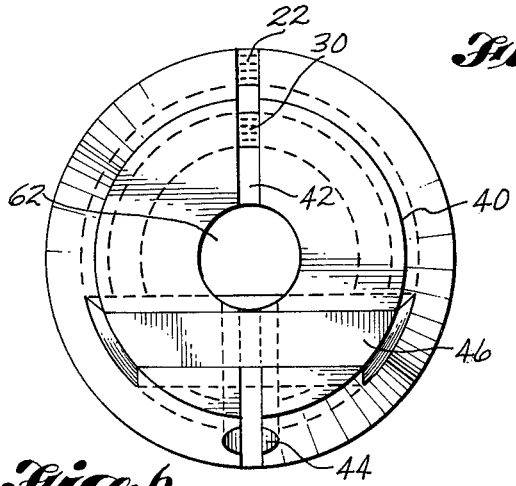
Fig. 6
Fig. 8
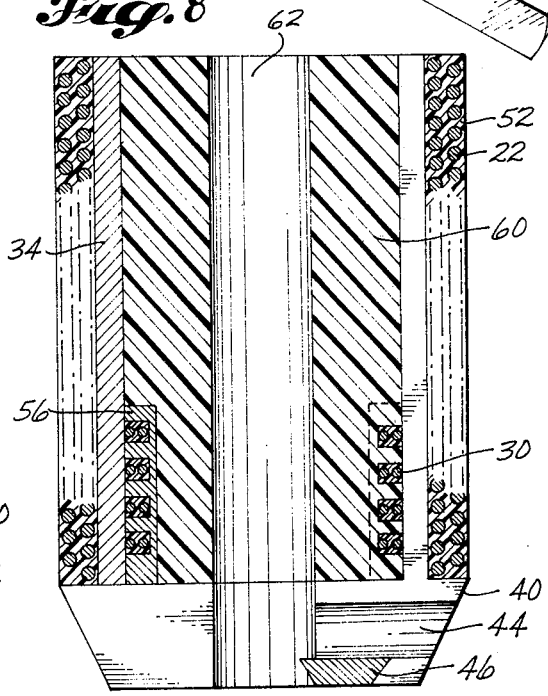
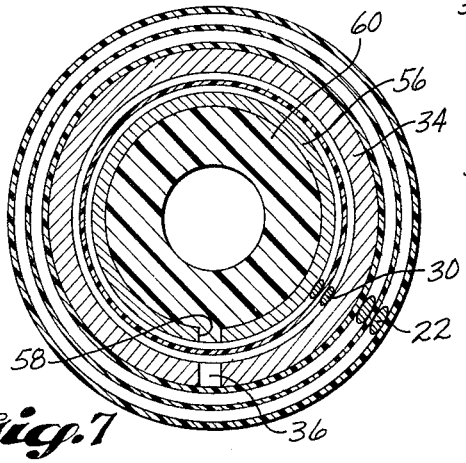
Fig. 7

FLUX CONCENTRATOR FOR ELECTROMAGNETIC PULLING

RELATIONSHIP TO OTHER APPLICATIONS

This application is related to application filed July 17, 1974, entitled "Electromagnetic Dent Puller"now U.S. Pat. No. 3,998,081: to follow on application Ser. No. 646,068, filed Jan. 2, 1976, entitled "Electromagnetic Dent Remover with Electromatic Localized Work Coil", and to follow on application Ser. No. 726,872, filed Sept. 27, 1976, entitled "Portable Head for Electromagnetic Pulling", all by the inventors named herein. The benefit of the filing date of these applications is claimed under 35 U.S.C. 120.

BACKGROUND OF THE INVENTION

This application relates to devices for pulling on conductive material, and may be used for proof testing, forming or dent removal, to name a few.

Electromagnetic forming of conductive materials has long been used with a high amplitude fast rise pulse of current to form conductive parts with a repulsing action. U.S. Pat. No. 3,124,726 discloses such a pushing type of forming where a massive hollow copper cylinder with a slit is used as a secondary coil to concentrate a pulsed primary current to radially compress a conductive part located in the axis of the cylinder.

U.S. Pat. No. 3,196,649 discloses a device for electromagnetic metal-forming by magnetic tension. This patent places a spiral, pancake type coil between a part to be formed and a secondary coil.

In U.S. Pat. No. 3,998,081, an electromagnetic puller for a conductive material had a coil first energized with a high amplitude current to set up a repulsing electromagnetic field slow pulsed to prevent deforming the conductive material; which was followed by a lower amplitude pulsed current to collapse the first field and set up an electromagnetic flux which pulled the coil and the part to be formed together with a force sufficient to remove dents. That patent also disclosed several coils shaped to act as flux concentrators to direct the electromagnetic forces to the desired area to remove dents. In application No. 646,068 other coils were disclosed which were shaped to act as flux concentrators, and application No. 726,872 disclosed a portable head with a flux concentrator for pulling out dents. The information contained in those applications, particularly the information describing the production and application of electrical current in the electromatic working coil of a dent removal head is incorporated herein by reference.

SUMMARY OF THE INVENTION

A single turn secondary coil is shaped to concentrate electromagnetic flux lines generated by a pair of primary coils, matched as to amplitude and pulse time, with the generated flux exerting a pulling force in an axial direction with respect to the secondary coil.

DESCRIPTION OF THE DRAWINGS

FIG. 4 shows a partially exploded perspective view partially in section of a flux concentrator of this invention.

FIG. 5 shows a side elevational section view taken along line 5—5 of FIG. 4.

FIG. 6 shows an end view as seen from line 6—6 of FIG. 5.

FIG. 7 shows a sectional view taken along lines 7—7 of FIG. 5.

FIG. 8 shows a side elevation sectional view taken along line 8—8 of FIG. 4.

DETAILED DESCRIPTION

Figure 1:
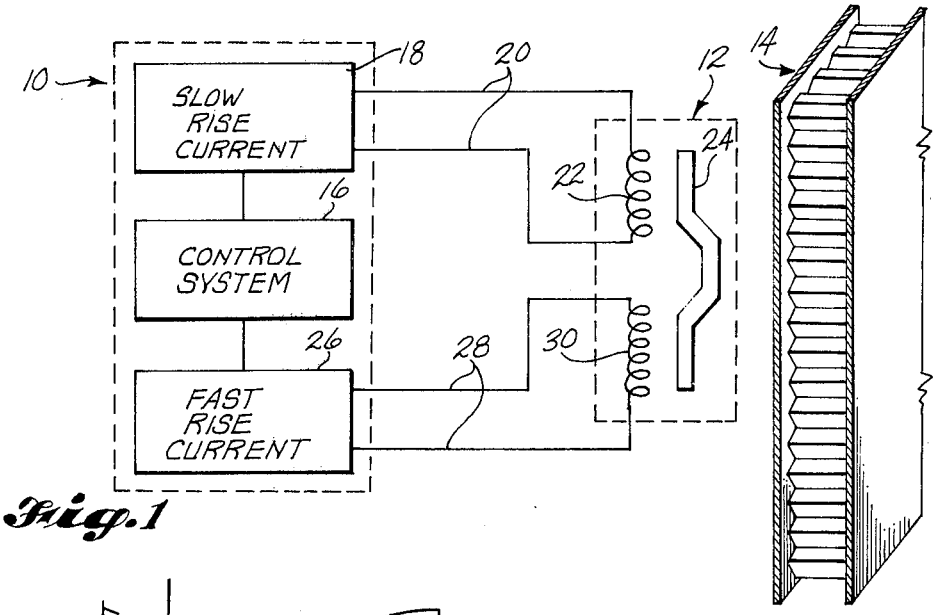
FIG. 1 shows a block diagram of the electrical circuit for the apparatus along with a fragmented perspective of a part to be pulled.
Figure 2:
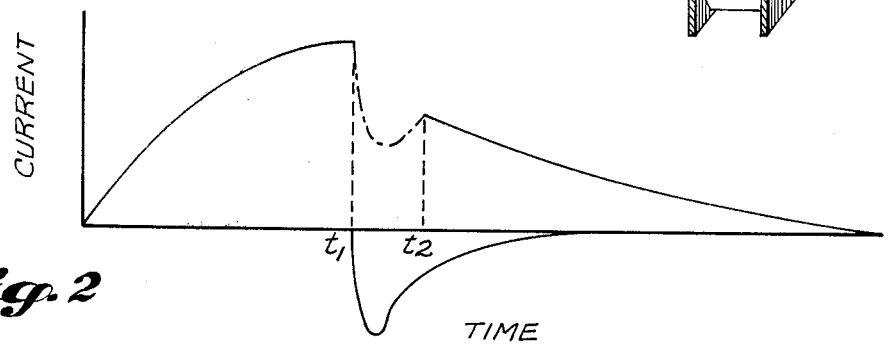
FIG. 2 is a diagram showing the amplitude and time relationship of the combined slow and fast pulses of current through a flux concentrator.
Figure 3:
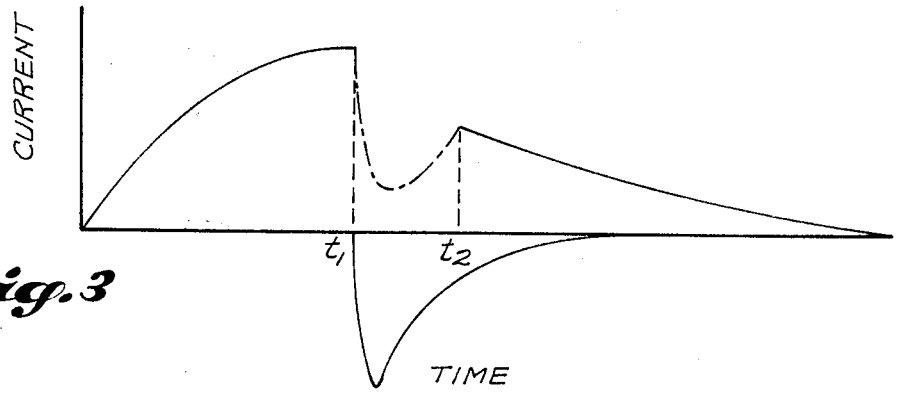
FIG. 3 is a diagram as in FIG. 2 with a different relationship between the two currents.

In electromagnetic pulling, a control panel 10 has the controls for operation of a portable head 12 which is used to pull on conductive material or part 14. Within the control panel is a control or logic system 16, which is set to first initiate a high amplitude slowly rising pulse of current 18: which may be generated by capacitors not shown. This current flows through conductors 20 to a first primary coil 22 located in the head and wound around a secondary coil 24. This slow pulsed current sets up a field in the secondary coil and generates flux lines seeking to push conductive part 14 away from the secondary coil. The slow rise of this current prevents the field from reaching a deforming intensity. At the proper time during the flow of slow rise current, the control system shuts off the slow rise current and initiates a fast rise rapid pulse current 26 which flows through lines 28 to a second primary coil 30 which is also wound around secondary coil 24. This current is 180 degrees out of phase with the first slow rise current and this reversed polarity current acting on the secondary coil rapidly collapses the field to generate a pulling electromagnetic force high enough to deform a part or to pull a dent out of a dented part.

A flux concentrator 32, see FIGS. 1 and 4 through 8, has a secondary coil 24 having a barrel or cylindrical member 34; which has a slot 36 extending longitudinally throughout the length of the cylindrical wall. This member has a large diameter bore 38 with a thin wall. A solid conductive head 40, in this embodiment, is integral with the cylindrical portion; however, it may be a separate member provided the two members are conductively joined together. The head member, shaped like a frustum of a cone, has a larger diameter than the cylindrical member. A slot 42 extends radially across the head from side to side with an enlarged portion 44 extending across half of the head. The slot in the head is aligned with respect to the slot 36 in the cylindrical member with the enlarged head portion 44 on the same side as slot 36. A conductive bridge member 46 fills a cross slot 48 to be in intimate conductive contact with head 40, and may be fastened in place by any known means such as, but not limited to, welding or brazing. The secondary coil preferably is made from copper with the bridge of beryllium copper. The beryllium copper has about the same conductivity as the copper, but is stronger in resistance to deformation. The bridge may alternately be an integral part of the head instead of a separate member and other conductive materials or combinations of conductive materials may be used. The large diameter of the bore of the cylindrical member, so as to give a relatively thin wall, gave the best results in concentrating the current induced in the secondary at the head in the end of the cylinder. It is believed the thickness of the cylindrical wall creates a situation where the induced current flows inside this member toward the head instead of circling the cylinder with the current flow almost entirely on the surface of the secondary as is found in pressure type central axis forming with a small bore thick wall single turn secondary coil.

The first primary coil 22 for the slow rise high amplitude electrical current 18 is preferably wound around the outer periphery 50 of the cylindrical portion 34 of the secondary coil 24 and is embedded in a plastic 52. The second primary coil 30 for the fast rise electrical current 26 is preferably wound in a spiral recess 54 of a conductive annular insert or ring 56. The insert is sized to contact the inside bore 38 of the cylinder 34 and is located adjacent the head 40. A recess 58 extends through the wall for the length of the insert and the recess is positioned to be aligned with the recess 36 in the cylindrical member 34. The annular insert is embedded in a non-conductive plastic 60 which fills all the inside of the cylinder except for an axial opening 62. This preferred embodiment shows the two primary coils on opposite sides of the cylindrical member 34, and the wall acts as a shield to prevent high voltage being induced in the first primary coil when the fast pulse of current flows through the second primary coil.

Figures 9, 10, 11, 12, 13:
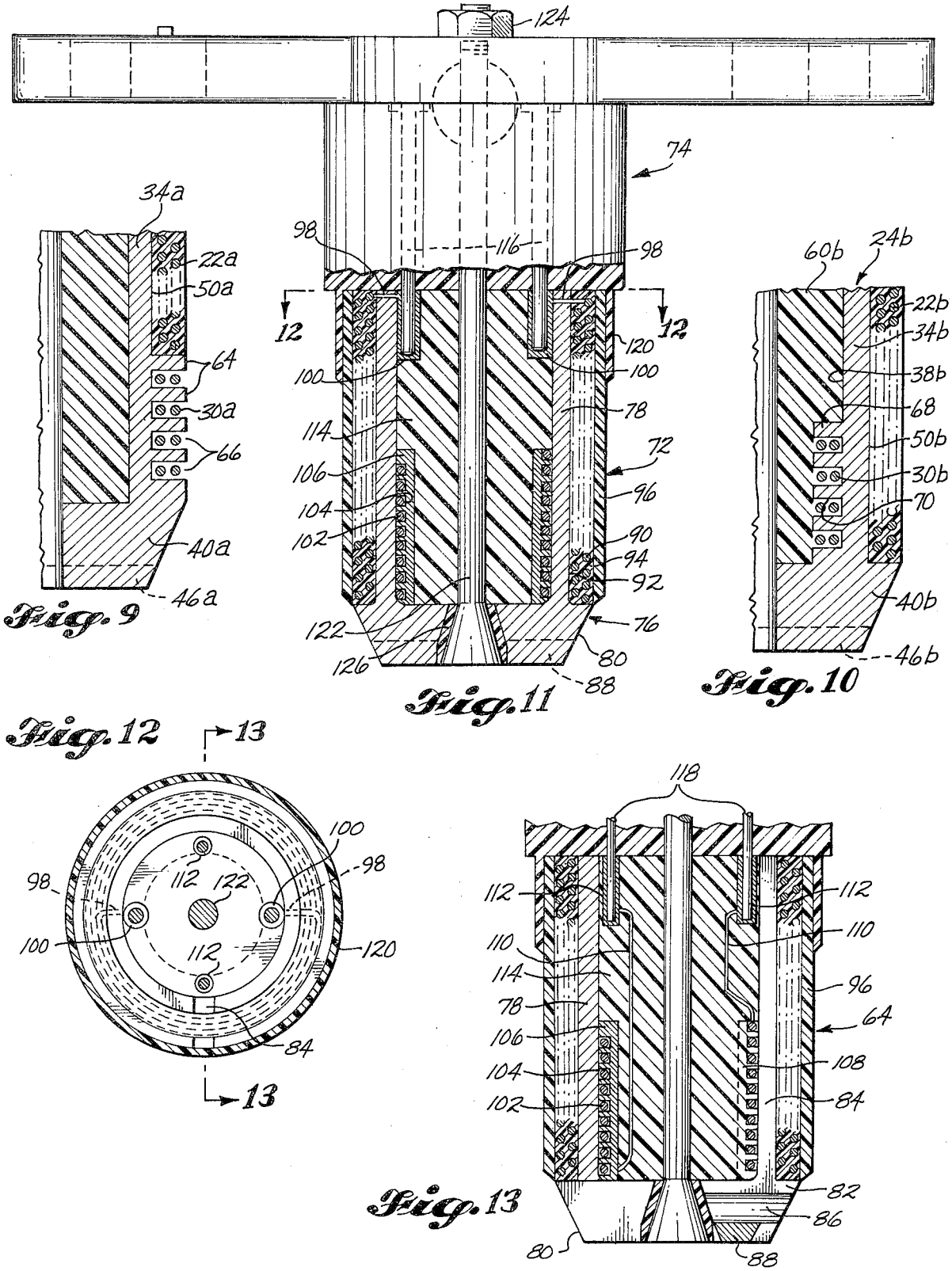
FIG. 9 shows a side elevational sectional view as in FIG. 5 of a lower right hand fragmented portion of a different embodiment of this invention.
FIG. 10 shows a lower right hand fragmented side elevational sectional view as in FIG. 9 of yet another embodiment of this invention.
FIG. 11 shows a side elevational partly sectional view of a different embodiment of this invention mounted in a portable head.
FIG. 12 is a sectional view taken along line 12—12 of FIG. 11.
FIG. 13 shows a sectional view taken along line 13—13 of FIG. 12.

FIG. 9 shows a different embodiment with a cylindrical member **34*a* of a secondary coil having an enlarged outer diameter 64 adjacent a head portion 40*a* and a bridge member 46*a*. The enlarged outer diameter has a spiral groove 66. A first primary coil 22*a* is wound around the outer diameter 50*a* of the cylindrical coil to receive a slow pulse high amplitude current, and a second primary coil 30*a* to receive a timed fast pulse lower amplitude current is wound into the groove 66**. Thus, both primary coils are wound around the outer periphery of the cylinder with the primary coil to handle the fast pulse adjacent the head at the end of the coil.

FIG. 10 shows yet another embodiment wherein a first primary coil **22*b* is wound around the outer periphery 50*b* of the cylindrical part 34*b* of a secondary coil 24*b*; which has integral head 40*b*, with bridge member 46*b*, at an end of the cylinder. The inside diameter of the cylindrical member is enlarged at 68 to accommodate a spiral groove 70 into which a second primary coil 30*b* is wound. The first primary coil is embedded in plastics 52*b* and the inside bore 38*b* of the cylinder is filled with plastic 60*b***.

FIGS. 11, 12 and 13 show yet another embodiment of a flux concentrator 72. The flux concentrator is detachably mounted to a portable head 74. The flux concentrator has a single turn secondary coil 76 with large bore cylindrical member 78 and an integral head member 80 at one end of the cylindrical member. The head member has slot 82 extending radially across the head and the slot is aligned with a slot 84 which extends the length of the cylindrical member. The slot across the head has an enlarged portion of the slot at 86 and a bridge member 88 extends across the slot. A first primary coil 90 using a large size wire is wound around the outer periphery 92 of the cylindrical member using many turns and is embedded in a plastic 94 which is encircled with another layer of plastic 96. The ends of the primary coil connects to conductors 98 which in turn are joined to receptacles 100. A second primary coil 102 is wound in a spiral recess 104 in a conductive annular ring 106 which is in contact with the cylindrical part of the secondary member. The annular ring has a longitudinal slot 108 along one side that is aligned with the slot in the cylindrical wall. The ends of the second primary coil connect to conductors 110 which in turn connect to receptacles 112. The annular ring and all of the receptacles are embedded in plastic 114. The portable head 74 has a pair of large prongs 116 for making electrical contact in receptacles 100, and has a pair of smaller prongs 118 for making electrical contact in receptacles 112 and also a plastic annular extension 120 to assist in alignment between the head and the flux concentrator. The flux concentrator is detachably joined to the head with bolt 122 and nut 124. A plastic sleeve 126 insulates the bolt from the secondary coil.

We claim:

1. A flux concentrator for electromagnetic pulling of a conductive material comprising: a first primary coil wound around an outer surface of a single turn secondary coil, said secondary coil having means for concentrating flux to exert electromagnetic force in an axial direction with respect to the secondary coil; a second primary coil wound adjacent an inner surface and an end of the secondary coil wherein the inside surface of the secondary coil has integral spirally formed radial grooves into which the second primary coil is wound; means for introducing a slow rise high amplitude electrical current to the first primary coil; means for quickly shutting off the slow rise high amplitude current; and means for introducing a timed fast rise reversed polarity electrical current to the second primary coil to generate an axially directed pulling electromagnetic flux at the secondary coil.

2. A flux concentrator for electromagnetic pulling of a conductive material comprising: a first primary coil wound around an outer surface of a single turn secondary coil, said secondary coil having means for concentrating flux to exert electromagnetic force in an axial direction with respect to the secondary coil; a second primary coil wound adjacent an inner surface and an end of the secondary coil a conductive annular member to contact the inside surface of the secondary coil, said member having outwardly extending spiral grooves into which the second primary coil is wound and the annular member having an axially extending slot on one side; means for introducing a slow rise high amplitude electrical current to the first primary coil; means for quickly shutting off the slow rise high amplitude current; and means for introducing a timed fast rise reversed polarity electrical current to the second primary coil to generate an axially directed pulling electromagnetic flux at the secondary coil.

3. A flux concentrator for electromagnetic pulling of a conductive material comprising: a first primary coil wound around a single turn secondary coil, said secondary coil having means for concentrating flux to exert electromagnetic force in an axial direction with respect to the secondary coil, a second primary coil wound around the secondary coil; means for introducing a slow rise high amplitude electrical current to the first primary coil; means for quickly shutting off the slow rise high amplitude current; means for introducing a timed fast rise reversed polarity electrical current to the second primary coil to generate an axially directed pulling electromagnetic flux at the secondary coil; and the amplitude of the fast rise electrical current to the second primary coil is from about 50 to 100 percent of the amplitude of the slow rise electrical current.

4. A flux concentrator for electromagnetic pulling of a conductive material comprising: a first primary coil wound around a single turn secondary coil, said secondary coil having means for concentrating flux to exert electromagnetic force in an axial direction with respect to the secondary coil, and said means having a barrel part of the single turn secondary coil having a large bore; a head of conductive material located at an end of the barrel, said head having a slot to extend radially across; and a conductive bridge to extend across the slot in the head; a second primary coil wound adjacent an inner surface and an end of the secondary coil; means for introducing a slow rise high amplitude electrical current to the first primary coil; means for quickly shutting off the slow rise high amplitude current; and means for introducing a timed fast rise reversed polarity electrical current to the second primary coil to generate an axially directed pulling electromagnetic flux at the secondary coil.

5. An apparatus for electromagnetically pulling dents from conductive materials comprising: a secondary coil with a solid cylindrical shaped conductive member having a large central axis bore, a longitudinally extending slot through a wall of the cylinder, and a solid conductive head to cover an end of the cylinder, the head having a radially extending slot from side to side and aligned as an extension of the slot in the cylinder and also having a conductive bridge across the slot in the head; means for introducing a slow rise high amplitude current in the secondary coil; and means for introducing a timed fast rise reverse polarity current in the secondary coil to generate pulling electromagnetic lines of force in an axial direction at the bridge.

6. An apparatus as in claim 5 wherein the secondary coil is of copper.

7. An apparatus as in claim 5 wherein the bridge of the secondary coil is of beryllium copper and the balance of the secondary coil is of copper.

8. A flux concentrator for electromagnetic pulling of a conductive material wherein the flux concentrator first receives a slow rise high amplitude electrical current from a control panel followed by a fast rise timed reversed polarity lower amplitude electrical current to generate an attracting force between the flux concentrator and the conductive material, and the flux concentrator comprises: a secondary coil with a solid cylindrical shaped member having a large central bore, a longitudinally extending slot through a wall of the cylinder, and a solid conductive head to cover an end of the cylinder, the head having a radially extending slot from side to side and aligned as an extension of the slot in the cylinder and also having a conductive bridge across the slot in the head; a first primary coil member to receive a slow rise electrical current, said coil wound around an outer surface of the cylindrical part of the secondary coil; an annular conductive insert having a spirally wound outwardly extending recess and a longitudinally extending slot through a wall, said insert located adjacent the head and an inner wall of the cylinder and with the slot aligned with the slot in the cylinder; and a second primary coil, to receive a reversed polarity fast rise current, wound in the recess of the annular insert.

9. A flux concentrator as in claim 8 wherein the bridge across the slot in the head is integral with the head.

10. A flux concentrator as in claim 8 wherein the bridge across the slot in the head is of beryllium copper.

11. A flux concentrator as in claim 8 wherein the annular insert is mounted in plastic.

12. A flux concentrator as in claim 11 further comprising means for quick connecting the flux concentrator to a portable head.

13. A flux concentrator as in claim 11 further comprising: the plastic member and insert removably mounted inside the cylindrical part of the secondary coil, and means for fastening the insert and secondary coil together.

14. A flux concentrator as in claim 13 further comprising: means for quick connecting the flux concentrator to a portable head.

15. A method of removing dents from a conductive material, the steps comprising: forming a secondary coil with a hollow large bore cylindrical member, a solid head for a working member at an end of the cylindrical member, a slot extending radially across the head and throughout one side of the cylindrical member, and a bridge member extending across the slot in the head; winding wire to form a primary coil around an outside of the cylindrical member; winding wire spirally adjacent the inside diameter of the cylindrical member and the head to form a second primary coil; placing the working head against a part having a dent to be removed with the bridge adjacent the dent; introducing a slowly rising high amplitude current through the first coil; and following this with a fast rising lower amplitude reversed polarity current in the second coil to generate collapsing flux lines that pull the dented material toward the head of the secondary coil.

* * * * *